US010746025B2

(12) United States Patent
Yoshida et al.

(10) Patent No.: US 10,746,025 B2
(45) Date of Patent: Aug. 18, 2020

(54) TURBINE WHEEL, RADIAL TURBINE, AND SUPERCHARGER

(71) Applicant: MITSUBISHI HEAVY INDUSTRIES ENGINE & TURBOCHARGER, LTD., Sagamihara-shi, Kanagawa (JP)

(72) Inventors: Toyotaka Yoshida, Tokyo (JP); Takao Yokoyama, Tokyo (JP)

(73) Assignee: MITSUBISHI HEAVY INDUSTRIES ENGINE & TURBOCHARGER, LTD., Sagamihara-Shi (JP)

( * ) Notice: Subject to any disclaimer, the term of this patent is extended or adjusted under 35 U.S.C. 154(b) by 31 days.

(21) Appl. No.: 16/075,779

(22) PCT Filed: Mar. 2, 2016

(86) PCT No.: PCT/JP2016/056381

§ 371 (c)(1),
(2) Date: Aug. 6, 2018

(87) PCT Pub. No.: WO2017/149693

PCT Pub. Date: Sep. 8, 2017

(65) Prior Publication Data

US 2019/0040743 A1 Feb. 7, 2019

(51) Int. Cl.

| | |
|---|---|
| ***F01D 5/14*** | (2006.01) |
| ***F02B 39/00*** | (2006.01) |
| ***F01D 5/04*** | (2006.01) |

(52) U.S. Cl.

CPC ..... *F01D 5/141* (2013.01); *F01D 5/04* (2013.01); *F01D 5/048* (2013.01); *F01D 5/14* (2013.01);

(Continued)

(58) Field of Classification Search

CPC . F01D 5/141; F01D 5/048; F01D 5/04; F01D 5/14; F02B 39/00; F05D 2250/713;

(Continued)

(56) References Cited

U.S. PATENT DOCUMENTS

2003/0228226 A1* 12/2003 Higashimori ..... F01D 5/04 416/243
2006/0039791 A1* 2/2006 Kim ..... F01D 5/048 416/228

(Continued)

FOREIGN PATENT DOCUMENTS

CN 1737378 A 2/2006
CN 101341312 A 1/2009

(Continued)

OTHER PUBLICATIONS

International Search Report (Form PCT/ISA/210) for International Application No. PCT/JP2016/056381, dated May 24, 2016, with English translation.

(Continued)

*Primary Examiner* — J. Todd Newton
(74) *Attorney, Agent, or Firm* — Birch, Stewart, Kolasch & Birch, LLP

(57) ABSTRACT

Suction surfaces of blades of this radial turbine each have: a leading edge side of blade tip including a leading edge and the boundary between the suction surface and the tip; and a trailing edge side of blade tip including a trailing edge and the boundary between the suction surface and the tip. The leading edge side of blade tip forms a concave curved surface which is recessed towards the side opposite to the rotation side in a radial view. The trailing edge side of blade tip forms a convex curved surface which protrudes towards the rotation side in a radial view.

6 Claims, 4 Drawing Sheets

(52) U.S. Cl.
CPC ..... *F02B 39/00* (2013.01); *F05D 2220/40* (2013.01); *F05D 2240/301* (2013.01); *F05D 2240/303* (2013.01); *F05D 2250/184* (2013.01); *F05D 2250/713* (2013.01); *F05D 2250/75* (2013.01)

(58) Field of Classification Search
CPC ..... F05D 2250/184; F05D 2250/75; F05D 2240/303; F05D 2240/301; F05D 2220/40
USPC ..... 416/243
See application file for complete search history.

(56) References Cited

U.S. PATENT DOCUMENTS

| | | | | |
|---|---|---|---|---|
| 2010/0098548 | A1* | 4/2010 | Yokoyama | F01D 1/08 416/223 R |
| 2012/0082552 | A1 | 4/2012 | Osako et al. | |

FOREIGN PATENT DOCUMENTS

| | | | |
|---|---|---|---|
| CN | 102459818 | A | 5/2012 |
| EP | 2 055 893 | A1 | 5/2009 |
| EP | 2 447 473 | A1 | 5/2012 |
| JP | 2004-011560 | A | 1/2004 |
| JP | 2008-128064 | A | 6/2008 |
| JP | 2008-133766 | A | 6/2008 |

OTHER PUBLICATIONS

Written Opinion of the International Searching Authority (Form PCT/ISA/237) for International Application No. PCT/JP2016/056381, dated May 24, 2016, with English translation.

* cited by examiner

TURBINE WHEEL, RADIAL TURBINE, AND SUPERCHARGER

TECHNICAL FIELD

The present invention relates to a turbine wheel, a radial turbine, and a turbocharger.

BACKGROUND ART

A turbine includes a turbine rotary shaft which is rotated about an axis, a turbine wheel which is fixed to an outer peripheral side of the turbine rotary shaft, and a housing which covers the turbine wheel. The turbine wheel includes a disk which is fixed to the turbine rotary shaft and a plurality of blades which are provided on an outer peripheral surface of the disk at intervals in a circumferential direction. In portions between the plurality of blades, a working fluid flows in from a portion between leading edges of the blades. The working fluid flows out from a portion between trailing edges of the blades.

In a radial turbine, a leading edge of a blade faces a radially outer side with respect to an axis. In addition, a trailing edge of the blade faces a rear side in an axial direction in which an axis extends. Accordingly, in the radial turbine, the working fluids flows in from a radially outer side and is extracted to the rear side in the axial direction.

For example, as the radial turbine, there is a radial turbine disclosed in the following PTL 1. A pressure surface of the radial turbine forms a concave curved surface which is recessed to a rotation side from the pressure surface toward a suction surface. In addition, the suction surface forms a convex curved surface which protrudes to the rotation side.

CITATION LIST

[PTL 1] Japanese Unexamined Patent Application Publication No. 2004-011560

SUMMARY OF INVENTION

Technical Problem

In a turbine, a turbine wheel is rotated relative to a housing, and thus, there is a gap between a tip of a blade and an inner peripheral surface of the housing. In general, this gap is referred to as a tip clearance. In order to increase turbine efficiency, it is preferable to set the tip clearance as small as possible. However, due to axial vibrations, thermal expansion of the turbine wheel, or the like, there is a limit to a reduction of the tip clearance to avoid a contact between the tip of the blade and the inner circumferential surface of the housing.

In the turbine, reducing a flow of a working fluid through the tip clearance, that is, reducing a clearance flow leads to improvement in the turbine efficiency. Accordingly, an object of the present invention is to provide a turbine wheel, a radial turbine, and a turbocharger capable of reducing the clearance flow.

Solution to Problem

In order to achieve the above-described object, according to a first aspect of the present invention, there is provided a turbine wheel including: a disk which has a shape rotationally symmetrical about an axis and a diameter which gradually decreases from a front side which is one side in an axial direction in which the axis extends toward a rear side which is the other side; a plurality of blades which are fixed to an outer peripheral surface of the disk at intervals in a circumferential direction D with respect to the axis, in which each of the blades includes a leading edge which extends in a direction including an axial component from a portion on the front side of the disk and faces a radially outer side with respect to the axis, a trailing edge which extends in a direction including a radial component with respect to the axis from a portion on the rear side of the disk and faces the rear side, a pressure surface and a suction surface which extend from the leading edge to the trailing edge and face sides opposite to each other, a tip which forms an edge on a side far from the outer peripheral surface, the suction surface includes a leading edge side of blade tip including a boundary between the suction surface and the tip and the leading edge and a trailing edge side of blade tip including a boundary between the suction surface and the tip and the trailing edge, the leading edge side of blade tip forms a concave curved surface which is recessed to an counterrotation side from the suction surface toward the pressure surface when viewed in a radial direction, and the trailing edge side of blade tip forms a convex curved surface which protrudes to a rotation side from the pressure surface toward the suction surface side when viewed in the radial direction.

There is a gap referred to as a tip clearance between the tip of the blade in the turbine wheel and an inner peripheral surface of a turbine housing covering the turbine wheel. A flow of a working fluid through the tip clearance, that is, a presence of a clearance flow leads to a decrease in turbine efficiency.

Here, a blade in which the entire suction surface is a convex curved surface protruding to the rotation side is defined as Comparative Example. In Comparative Example, as a result of the clearance flow, a leakage fluid which has flowed from a pressure surface side of the blade to a suction surface side becomes a vortex flow, and flows along the suction surface of the blade. The flow of the leakage fluid along the suction surface of the blade attracts the clearance flow.

Meanwhile, in the turbine wheel, the leading edge side of blade tip in the suction surface of the blade is the concave curved surface which is recessed to the counterrotation side. Accordingly, in the turbine wheel, a separation angle of the clearance flow with respect to the suction surface in the present embodiment is larger than a separation angle of the clearance flow with respect to the suction surface in Comparative Example. Accordingly, in the turbine wheel, most of the leakage fluid flowing to the suction surface side of the blade through the tip clearance in the portion on the leading edge side of the blade is not attached to the suction surface of the blade and flows to be separated from the suction surface. In this way, in the turbine wheel, most of the leakage fluid flows to be separated from the suction surface of the blade, and thus, it is possible to suppress attraction of the clearance flow. As a result, compared to Comparative Example, in the turbine wheel, it is possible to reduce the clearance flow and increase the turbine efficiency.

In the turbine wheel according to a second aspect of the present invention in order to achieve the above-described object, in the turbine wheel of the first aspect, the suction surface has a root portion which includes a boundary between the suction surface and the outer peripheral surface, the leading edge, and the trailing edge, and is in contact with the leading edge side of blade tip and the trailing edge side of blade tip, and the root portion forms a convex curved surface which protrudes to the rotation side.

In the turbine wheel according to a third aspect of the present invention in order to achieve the above-described object, in the turbine wheel of the second aspect, a boundary line between the leading edge side of blade tip and the root portion is positioned at a position which is less than half a blade height from the tip in a blade height direction.

In the turbine wheel according to a fourth aspect of the present invention in order to achieve the above-described object, in the turbine wheel of any one of the first to third aspects, the leading edge side of blade tip and the trailing edge side of blade tip are in contact with each other, and a boundary line between the leading edge side of blade tip and the trailing edge side of blade tip on a tip line formed at a boundary between the tip and the suction surface is positioned at a position at which a distance from the leading edge to the boundary line is equal or more than half the entire length of the tip line.

In the turbine wheel according to a fifth aspect of the present invention in order to achieve the above-described object, in the turbine wheel of any one of the first to fourth aspects, a curvature radius of the concave curved surface in the leading edge side of blade tip is equal to or more than a curvature radius of the convex curved surface in the trailing edge side of blade tip.

In the turbine wheel according to a sixth aspect of the present invention in order to achieve the above-described object, in the turbine wheel of any one of the first to fifth aspects, the pressure surface includes a leading edge side of blade tip including a boundary between the pressure surface and the tip and the leading edge and a trailing edge side of blade tip including a boundary between the pressure surface and the tip and the trailing edge, the leading edge side of blade tip of the pressure surface forms a convex curved surface which protrudes to the counterrotation side when viewed in the radial direction, and the trailing edge side of blade tip of the pressure surface forms a concave curved surface which is recessed to the rotation side when viewed in the radial direction.

According to a seventh aspect of the present invention in order to achieve the above-described object, there is provided a radial turbine including: the turbine wheel according to any one of the first to sixth aspects; a turbine rotary shaft which extends in the axial direction about the axis and to which the turbine wheel is fixed; and a turbine housing which covers the turbine wheel to be rotatable.

According to an eighth aspect of the present invention in order to achieve the above-described object, there is provided a turbocharger including: the radial turbine according to the seventh aspect; and a compressor, in which the compressor includes a compressor rotary shaft which is rotated about the axis, an impeller which is fixed to the compressor rotary shaft, and a compressor housing which covers the impeller, in which the turbine rotary shaft and the compressor rotary shaft are positioned on the same axis to be connected to each other and are integrally rotated with each other to form a turbocharger rotary shaft.

Advantageous Effects of Invention

According to an aspect of the present invention, it is possible to reduce the clearance flow.

DESCRIPTION OF EMBODIMENTS

Hereinafter, an embodiment of a turbocharger according to the present invention will be described with reference to the drawings.

Figure 1:
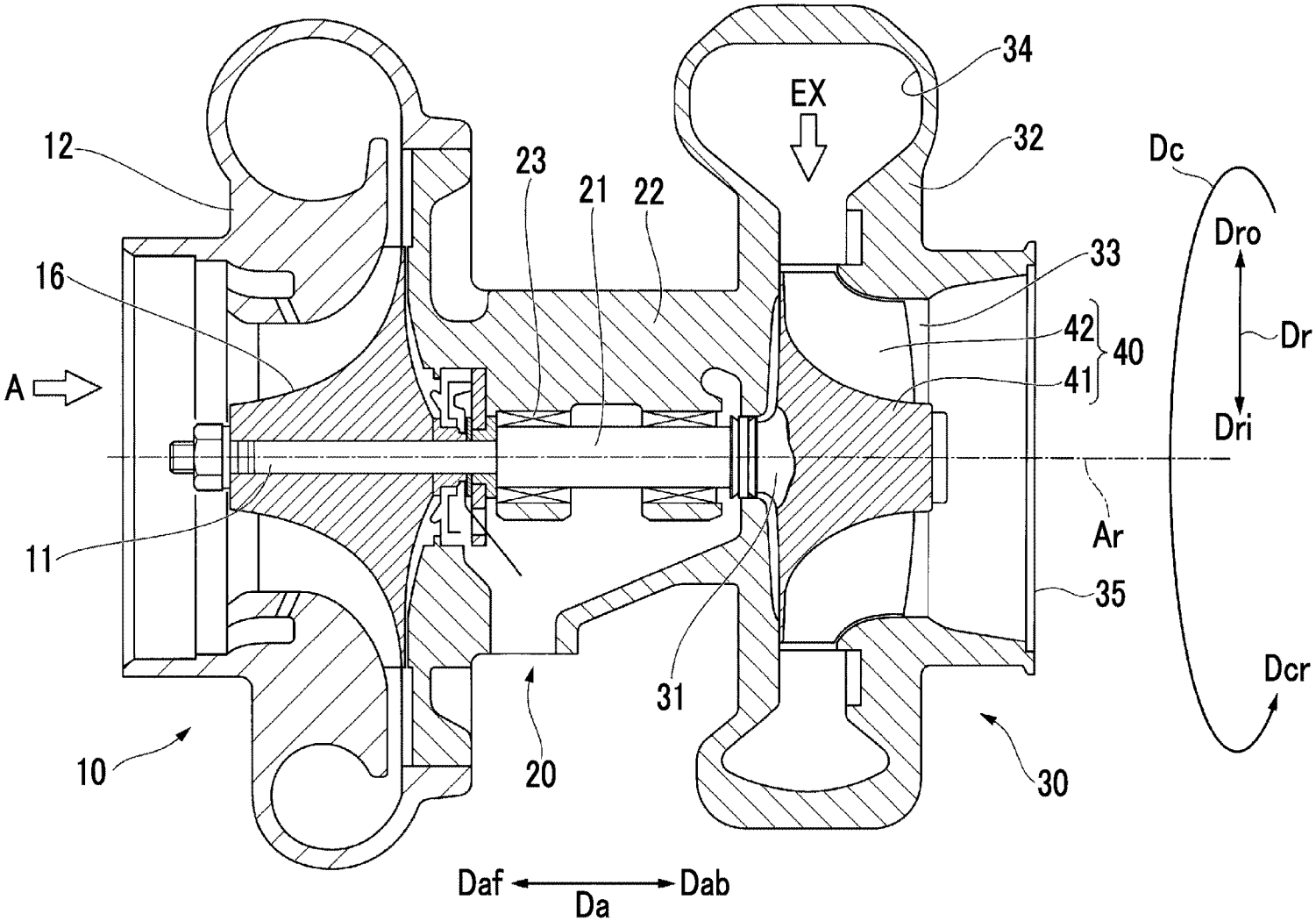
FIG. 1 is a cross-sectional view of a turbocharger in an embodiment of the present invention.

As shown in FIG. 1, the turbocharger of the present embodiment includes a compressor 10 which compresses air A and feeds an engine, a radial turbine 30 which is driven by an exhaust gas EX from the engine, and a connection portion 20 which connects the compressor 10 and the radial turbine 30 to each other.

The compressor 10 is a columnar compressor rotary shaft 11 which is rotated about an axis Ar, a compressor impeller 16 which is attached to an outer periphery of the compressor rotary shaft 11, ad a compressor housing 12 which covers the compressor impeller 16.

The radial turbine 30 includes a turbine rotary shaft 31 which is rotated about the axis Ar, a turbine wheel 40 which is attached to the turbine rotary shaft 31, and a turbine housing 32 which covers the turbine wheel 40.

The connection portion 20 includes a columnar connection rotary shaft 21 which is rotated about the axis Ar, a center housing 22 which covers the connection rotary shaft 21, and a bearing 23 which rotatably supports the connection rotary shaft 21. The bearing 23 is fixed to an inner peripheral side of the center housing 22.

The axis Ar of the compressor rotary shaft 11, the axis Ar of the connection rotary shaft 21, and the axis Ar of the turbine rotary shaft 31 are disposed so as to be arranged in this order on the same axis Ar. The compressor rotary shaft 11, the connection rotary shaft 21, and the turbine rotary shaft 31 are connected to each other to be integrally rotated, and form a turbocharger rotary shaft. In addition, the compressor housing 12, the center housing 22, and the turbine housing 32 are connected to each other so as to form a turbocharger housing.

Here, a direction in which the axis Ar extends is referred to as an axial direction Da, one side in the axial direction Da is referred to as an axially front side Daf, and the other side in the axial direction Da is referred to as an axially rear side Dab. In the present embodiment, the compressor 10 is provided on the axially front side Daf with respect to the connection portion 20 and the radial turbine 30 is provided on the axially rear side Dab with respect to the connection portion 20. In addition, a radial direction with respect to the axis Ar is simply referred to as a radial direction Dr, a side far from the axis Ar in the radial direction Dr is referred to as a radially outer side Dro, and a side close to the axis Ar in the radial direction Dr is referred to as a radial inner side Dri. In addition, a circumferential direction about the axis Ar is simply referred to as a circumferential direction Dc. A side on which the turbine wheel 40 is rotated in the circumferential direction Dc is referred to as a circumferentially rotation side Dcr.

Figure 2:
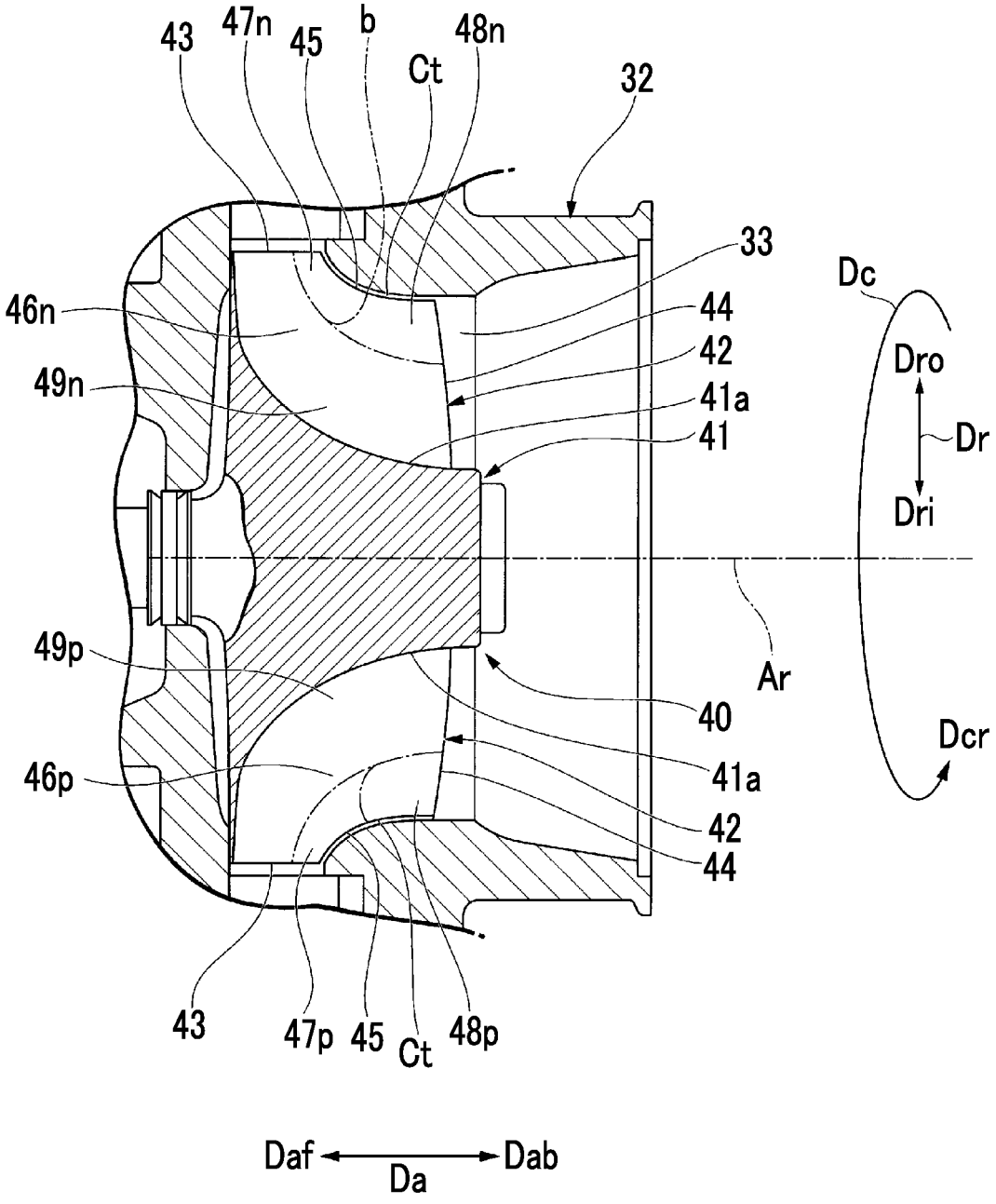
FIG. 2 is a main cross-sectional view of a radial turbine in the embodiment of the present invention.
Figure 3:
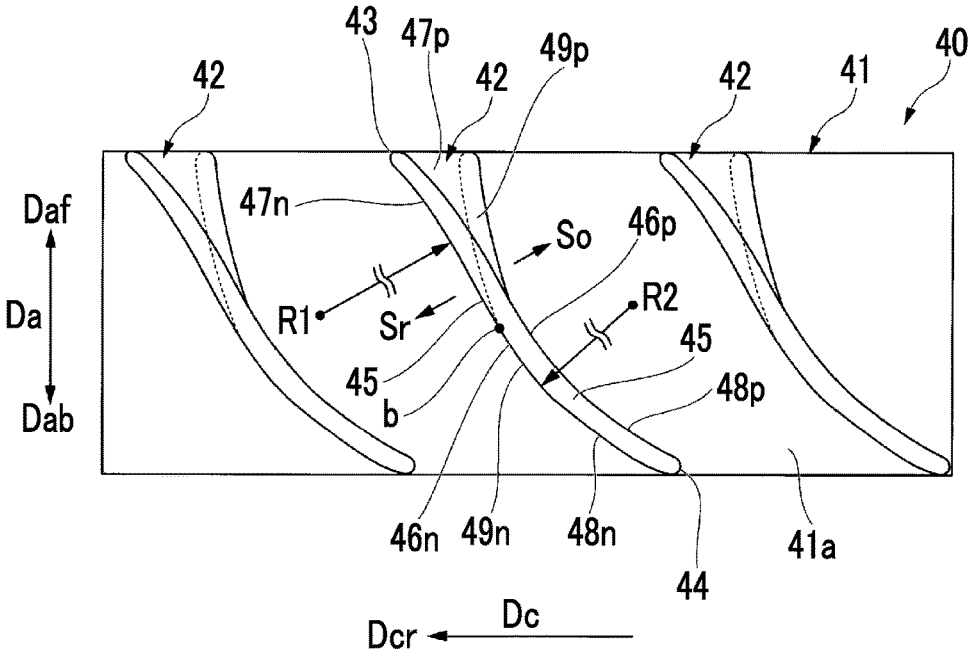
FIG. 3 is a development view of a turbine wheel in the embodiment of the present invention.
Figure 4:
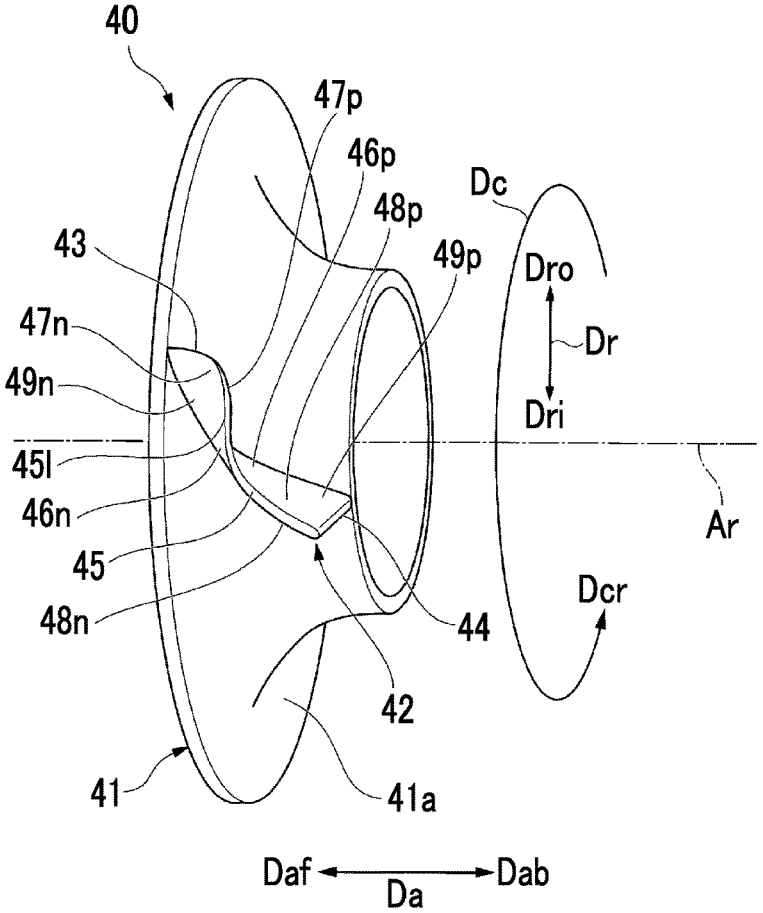
FIG. 4 is a perspective view of the turbine wheel in the embodiment of the present invention.

As shown in FIGS. 2 to 4, the turbine wheel 40 includes a disk 41 and a plurality of blades 42. The disk 41 has a shape rotationally symmetrical about the axis Ar and a diameter of the disk 41 gradually decreases toward the axially rear side Dab. The plurality of blades 42 are fixed to an outer peripheral surface 41*a* of the disk 41 at intervals in the circumferential direction Dc.

As shown in FIGS. 2 and 4, each of the blades 42 includes a leading edge 43, a trailing edge 44, a tip 45, a pressure surface 46*p*, and a suction surface 46*n*. The leading edge 43 extends in a direction including an axial component from a portion on the axially front side Daf of the disk 41 and faces the radially outer side Dro. The trailing edge 44 extends in a direction including a radial component from a portion on the axially rear side Dab of the disk 41 and faces the axially rear side Dab. The pressure surface 46*p* and the suction surface 46*n* extend from the leading edge 43 to the trailing edge 44 and face sides opposite to each other. Accordingly, the pressure surface 46*p* and the suction surface 46*n* are in a back-to-back relationship. The suction surface 46*n* faces the circumferentially rotation side Dcr and the pressure surface 46*p* faces a side opposite to the circumferentially rotation side Dcr. The tip 45 of the blade 42 is an edge on a side far from the outer peripheral surface 41*a* of the disk 41.

The suction surface 46*n* includes a leading edge side of blade tip 47*n*, a trailing edge side of blade tip 48*n*, and a root portion 49*n*. The leading edge side of blade tip 47*n* is a portion which includes a boundary between the tip 45 and the suction surface 46*n*, and the leading edge 43. The trailing edge side of blade tip 48*n* is in contact with the leading edge side of blade tip 47*n* and is a portion which includes the boundary between the tip 45 and the suction surface 46*n*, and the trailing edge 44. The root portion 49*n* is in contact with the leading edge side of blade tip 47*n* and the trailing edge side of blade tip 48*n*, and is a portion which includes a boundary between the outer peripheral surface 41*a* of the disk 41 and the suction surface 46*n*, the leading edge 43, and the trailing edge 44. In the suction surface 46*n*, the leading edge side of blade tip 47*n*, the trailing edge side of blade tip 48*n*, and the root portion 49*n* do not overlap each other.

Here, a side from the pressure surface 46*p* toward the suction surface 46*n* is referred to as a rotation side Sr (refer to FIG. 3). In addition, a side from the suction surface 46*n* toward the pressure surface 46*p* is referred to as an counterrotation side So.

As shown in FIG. 3, when the blade 42 is viewed in the radial direction, the leading edge side of blade tip 47*n* forms a concave curved surface which is recessed to the counter-rotation side So. When the blade 42 is viewed in the radial direction, the trailing edge side of blade tip 48*n* forms a convex curved surface which protrudes to the rotation side Sr. When the blade 42 is viewed in the radial direction, the root portion 49*n* of the suction surface 46*n* forms a convex curved surface which protrudes to the rotation side Sr.

For example, a curvature radius R1 of the concave curved surface in the leading edge side of blade tip 47*n* is equal to or more than a curvature radius R2 of the convex curved surface in the trailing edge side of blade tip 48*n*. Moreover, for example, a boundary line b between the leading edge side of blade tip 47*n* and the trailing edge side of blade tip 48*n* on a tip line 45*l* formed at a boundary between the tip 45 and the suction surface 46*n* is positioned at a position at which a distance from the leading edge 43 to the boundary line b is equal or more than half the entire length of the tip line 45*l*. In addition, as shown in FIG. 2, a boundary line between the leading edge side of blade tip 47*n* and the root portion 49*n* is positioned at a position which is less than half a blade height from the tip 45 in a blade height direction.

Similarly to the suction surface 46*n*, as shown FIGS. 2 and 4, the pressure surface 46*p* includes a leading edge side of blade tip 47*p*, a trailing edge side of blade tip 48*p*, and a root portion 49*p*. The leading edge side of blade tip 47*p* is a portion which includes a boundary between the tip 45 and the pressure surface 46*p*, and the leading edge 43. The trailing edge side of blade tip 48*p* is in contact with the leading edge side of blade tip 47*p* and is a portion which includes the boundary between the tip 45 and the pressure surface 46*p*, and the trailing edge 44. The root portion 49*p* is in contact with the leading edge side of blade tip 47*p* and the trailing edge side of blade tip 48*p*, and is a portion which includes a boundary between the outer peripheral surface 41*a* of the disk 41 and the pressure surface 46*p*, the leading edge 43, and the trailing edge 44. In the pressure surface 46*p*, the leading edge side of blade tip 47*p*, the trailing edge side of blade tip 48*p*, and the root portion 49*p* do not overlap each other.

As shown in FIG. 3, when the blade 42 is viewed in the radial direction, the leading edge side of blade tip 47*p* of the pressure surface 46*p* forms a convex curved surface which protrudes to the counter-rotation side So. When the blade 42 is viewed in the radial direction, the trailing edge side of blade tip 48*p* of the pressure surface 46*p* forms a concave curved surface which is recessed to the rotation side Sr. When the blade 42 is viewed in the radial direction, the root portion 49*p* of the pressure surface 46*p* forms a concave curved surface which is recessed to the rotation side Sr.

As shown in FIG. 1, the turbine housing 32 includes a wheel chamber 33 in which the turbine wheel 40 is rotatably accommodated, a scroll flow path 34 to which a working fluid F (EX) flows, and an exhaust port 35 to which the working fluid F is exhausted. The scroll flow path 34 is a flow path which extends in a direction including a circumferential components. The scroll flow path 34 is a portion on the axially rear side Dab of the wheel chamber 33 and communicates with the wheel chamber 33 at a portion on the radially outer side Dro of the wheel chamber 33. The working fluid F which has flowed into the scroll flow path 34 flows from the radially outer side Dro into the wheel chamber 33 through the communication portion. The wheel chamber 33 is open at an end on the axially rear side Dab. This opening is the above-described exhaust port 35. The working fluid F which has flowed into the wheel chamber 33 is exhausted form the exhaust port 35.

Figure 5:
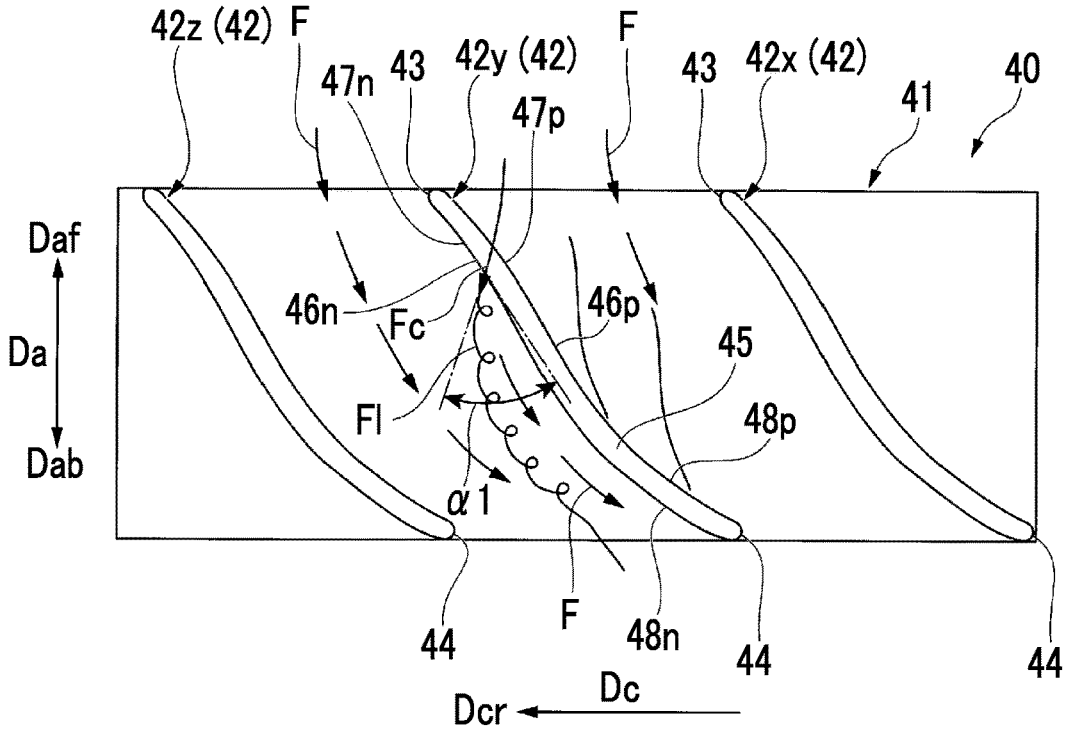
FIG. 5 is an explanatory view showing a flow of a working fluid in the radial turbine in the embodiment of the present invention.

As shown in FIG. 5, the working fluid F which has flowed into the wheel chamber 33 flows from a portion between the leading edges 43 of the respective blades 42 into a portion between the blades 42 in the turbine wheel 40. The working fluid F which has flowed into the portion between the blades 42 flows out from a portion between the trailing edges 44 of the respective blades 42. In a process in which the working fluid F flows through the portion between the blades 42, the working fluid F imparts a rotational force to the turbine wheel 40. In addition, in the present embodiment, the working fluid F is the exhaust gas EX.

There is a gap referred to as a tip clearance Ct (refer to FIG. 2) between the tip 45 of the blade 42 and a portion facing the tip 45 on an inner peripheral surface of the turbine housing 32. In order to increase turbine efficiency, it is preferable to set the tip clearance Ct as small as possible. However, due to axial vibrations, thermal expansion of the turbine wheel 40, or the like, there is a limit to a reduction of the tip clearance Ct to avoid a contact risk between the tip 45 of the blade 42 and the inner circumferential surface of the turbine housing 32.

The flow of the working fluid F extracted from the tip clearance Ct, that is, a presence of a clearance flow causes a decrease in the turbine efficiency. Accordingly, it is preferable to reduce to the clearance flow.

Figure 6:
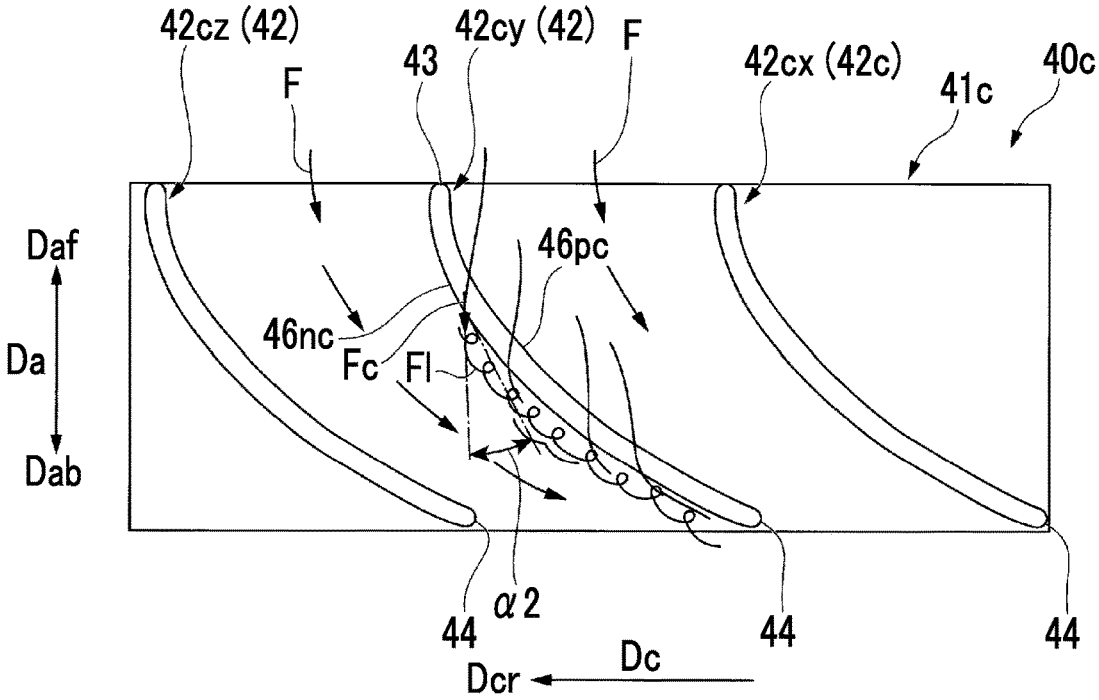
FIG. 6 is an explanatory view showing a flow of a working fluid in a radial turbine in Comparative Example.

Here, before the clearance flow in the present embodiment is described, a clearance flow in a turbine wheel of Comparative Example will be described with reference to FIG. 6.

A turbine wheel 40*c* of Comparative Example also includes a disk 41*c* and a plurality of blades 42*c*. The entire pressure, surface 46*pc* of each of the blades 42*c* forms a concave curved surface which is recessed to the rotation side Sr. In addition, the entire suction surface 46*nc* of each of the blades 42*c* forms a convex curved surface which protrudes to the rotation side Sr.

As described above, most of the working fluid F which has flowed into a portion between a first blade 42*cx* and a second blade 42*cy* adjacent to each other in the circumferential direction Dc flows out from a portion between the trailing edges 44 of the blades 42*cx* and 42*cy*. However, a portion of the working fluid F flows from a pressure surface 46*pc* of the second blade 42*cy* to a suction surface 46*nc* side of the second blade 42*cy* via the tip clearance Ct in the second blade 42*cy*, as a leakage fluid Fl. That is, a portion of the working fluid F flows into a portion between the second blade 42*cy* and a third blade 42*cz* via the tip clearance Ct in the second blade 42*cy*, as the leakage fluid Fl.

The leakage fluid Fl which has flowed into the portion between the second blade 42*cy* and the third blade 42*cz* becomes a vortex flow, is attached to the suction surface 46*nc* of the second blade 42*cy*, and flows along the suction surface 46*nc*. The clearance flow is attracted by the flow of the leakage, fluid Fl along the suction surface 46*nc* of the second blade 42*cy*. Therefore, due to the clearance flow Fc generated in the portion on the leading edge 43 side of the second blade 42*cy*, a clearance flow is also generated in an intermediate portion between the leading edge 43 and the trailing edge 44 of the second blade 42*cy*. Due to the attracted clearance flow, leakage fluid Fl which has flowed into a portion between the second blade 42*cy* and the third blade 42*cz* also becomes a vortex flow and flows along the suction surface 46*nc* of the second blade 42*cy*. The clearance flow is also attracted by the flow of the leakage fluid Fl along the suction surface 46*nc* of the second blade 42*cy*. Accordingly, the clearance flow is generated in a portion on the trailing edge 44 side of the second blade 42*cy* by the clearance flow generated in an intermediate portion of the second blade 42*cy*.

That is, in Comparative Example, the clearance flow is generated in the entire blade 42*c* from the leading edge 43 to the trailing edge 44 of the blade 42*c*.

Next, the clearance flow in the present embodiment will be described with reference to FIG. 5.

In the present embodiment, as the leakage fluid Fl, a portion of the working fluid F which has flowed into a portion between a first blade 42*x* and a second blade 42*y* flows from the pressure surface 46*p* side of the second blade 42*y* into the suction surface 46*n* side of the second blade 42*y* through the tip clearance Ct in the second blade 42*y* on the leading edge 43 side of the second blade 42*y*. That is, as the leakage fluid Fl, a portion of the working fluid F flows into the portion between the second blade 42*y* and the third blade 42*z* through the tip clearance Ct in the portion on the leading edge 43 side of the second blade 42*y*.

In the present embodiment, the leakage fluid Fl which has flowed into the portion between the second blade 42*y* and the third blade 42*z* becomes a vertex flow. However, in the present embodiment, most of the leakage fluid Fl is separated from the suction surface 46*n* of the second blade 42*y* and flows to the trailing edge 44 sides of the blades 42*y* and 42*z* through a portion between the second blade 42*y* and the third blade 42*z*.

The entire suction surface 46*n* of Comparative Example is the convex curved surface which protrudes to the rotation side Sr. Meanwhile, the leading edge side of blade tip 47*n* in the suction surface 46*n* of the present embodiment is the concave curved surface which is recessed to the counterrotation side So. Accordingly, a separation angle $\alpha$1 of the clearance flow Fc with respect to the suction surface 46*nc* in the present embodiment is larger than a separation angle $\alpha$2 of the clearance flow Fc with respect to the suction surface 46*nc* in Comparative Example. In addition, the separation angle $\alpha$ is an angle between a tangent with respect to the suction surface at a position where the clearance flow Fc crosses the boundary between the suction surface and the tip, and the clearance flow Fc. Accordingly, in the present embodiment, most of the leakage fluid Fl which has flowed into the portion between the second blade 42*y* and the third blade 42*z* through the tip clearance Ct in the portion on the leading edge 43 side of the second blade 42*y* is not attached to the suction surface 46*n* of the second blade 42*y*, and flows to be separated from the suction surface 46*n*. The working fluid F which has flowed into the portion between the second blade 42*y* and the third blade 42*z* flows into a portion between the flow of the leakage fluid Fl and the suction surface 46*n* of the second blade 42*y*.

As a result, in the present embodiment, even when the clearance flow Fc is generated in the portion on the leading edge 43 side of the second blade 42*y*, a new clearance flow Fc is not attracted by the clearance flow Fc. Accordingly, compared to Comparative Example, in the present embodiment, it is possible to reduce the clearance flow Fc and increase the turbine efficiency.

Meanwhile, if a size of the radial turbine 30 decreases, in general, the tip clearance Ct decreases. However, even when the size of the radial turbine 30 decreases, the tip clearance Ct does not become so small. The reason for this is that, as described above, the tip clearance Ct is a gap for avoiding contact between the tip 45 of the blade 42 and the inner peripheral surface of the turbine housing 32 due to the axial vibrations, the thermal expansion of the turbine wheel 40, or the like. Therefore, a ratio of the tip clearance Ct with respect to a length of the leading edge 43 or a length of the trailing edge 44 increases as the size of the radial turbine 30 decreases. Accordingly, as the size of the radial turbine 30 decreases, a ratio of a flow rate of a clearance flow with respect to a flow rate of the working fluid F flowing into the radial turbine 30 increases.

Accordingly, for example, in the radial turbine 30 used for the turbocharger for medium or small passenger cars, in order to increase a reduction rate of the clearance flow, as described above, preferably, the boundary line b on the tip line 45*l* between the leading edge side of blade tip 47*n* and the trailing edge side of blade tip 48*n* in the suction surface 46*n* is positioned at the position at which the distance of the boundary line b from the leading edge 43 is equal to or more than half the entire length of the tip line 45*l*. In addition, as described above, preferably, the curvature radius R1 of the concave curved surface in the leading edge side of blade tip

47*n* is equal to or more than the curvature radius R2 of the convex curved surface in the trailing edge side of blade tip 48*n*.

INDUSTRIAL APPLICABILITY

In an aspect of the present invention, it is possible to reduce the clearance flow.

REFERENCE SIGNS LIST

10: compressor
11: compressor rotary shaft
12: compressor housing
16: compressor impeller
20: connection portion
21: connection rotary shaft
22: center housing
23: bearing
30: radial turbine
31: turbine rotary shaft
32: turbine housing
33: wheel chamber
34: scroll flow path
35: exhaust port
40: turbine wheel
41: disk
41*a*: outer peripheral surface
42: blade
43: leading edge
44: trailing edge
45: tip
45*l*: tip line
46*n*: suction surface
46*p*: pressure surface
47*n*, 47*p*: leading edge side of blade tip
43*n*, 48*p*: trailing edge side of blade tip
49*n*, 49*p*: root portion
Ct: tip clearance
F: working fluid
Fc: clearance flow
Fl: leakage fluid
Ar: axis
Da: axial direction
Dab: axially rear side
Daf: axially front side
Dc: circumferential direction
Dr: radial direction
Dri: radial inner side
Dro: radially outer side
Sr: rotation side
So: counterrotation side

The invention claimed is:

1. A turbine wheel comprising:

a disk which has a shape rotationally symmetrical about an axis and a diameter which gradually decreases from a front side which is one side in an axial direction in which the axis extends toward a rear side which is the other side;

a plurality of blades which are fixed to an outer peripheral surface of the disk at intervals in a circumferential direction D with respect to the axis, wherein each of the blades includes a leading edge which extends in a direction including an axial component from a portion on the front side of the disk and faces a radially outer side with respect to the axis, a trailing edge which extends in a direction including a radial component with respect to the axis from a portion on the rear side of the disk and faces the rear side, a pressure surface and a suction surface which extend from the leading edge to the trailing edge and face sides opposite to each other, a tip which is formed at the outmost side of each blade with respect to the outer peripheral surface of the disk, wherein the suction surface includes a leading edge side of blade tip including a boundary between the suction surface and the tip and the leading edge, a trailing edge side of blade tip including a boundary between the suction surface and the tip and the trailing edge, and a root portion which includes a boundary between the suction surface and the outer peripheral surface, the leading edge, and the trailing edge, and is in contact with the leading edge side of blade tip and the trailing edge side (48*n*) of blade tip, wherein the leading edge side of blade tip forms a concave curved surface which is recessed to an counterrotation side from the suction surface toward the pressure surface when viewed in a radial direction, wherein the trailing edge side of blade tip forms a convex curved surface which protrudes to a rotation side from the pressure surface toward the suction surface side when viewed in the radial direction, and the entire root portion of the suction surface forms a convex cured surface which protrudes to the rotation side when viewed in the radial direction, a boundary line between the leading edge of blade tip and the root portion is positioned at a position which is less than half a blade height from the top in a blade height direction, and in the suction surface, the leading edge side of blade tip, the trailing edge of blade tip, and the root portion are formed to not to overlap each other.

2. The turbine wheel according to claim 1, wherein the leading edge side of blade tip and the trailing edge side of blade tip are in contact with each other, and wherein a boundary line between the leading edge side of blade tip and the trailing edge side of blade tip on a tip line formed at a boundary between the tip and the suction surface is positioned at a position at which a distance from the leading edge to the boundary line is equal or more than half the entire length of the tip line.

3. The turbine wheel according to claim 1, wherein a curvature radius of the concave curved surface in the leading edge side of blade tip is equal to or more than a curvature radius of the convex curved surface in the trailing edge side of blade tip.

4. The turbine wheel according to claim 1, wherein the pressure surface includes a leading edge side of blade tip including a boundary between the pressure surface and the tip and the leading edge and a trailing edge side of blade tip including a boundary between the pressure surface and the tip and the trailing edge, wherein the leading edge side of blade tip of the pressure surface forms a convex curved surface which protrudes to the counter rotation side when viewed in the radial direction, and wherein the trailing edge side of blade tip of the pressure surface forms a concave curved surface which is recessed to the rotation side when viewed in the radial direction.

5. A radial turbine comprising:

the turbine wheel according to claim 1;

a turbine rotary shaft which extends in the axial direction about the axis and to which the turbine wheel is fixed; and a turbine housing which covers the turbine wheel to be rotatable.

6. A turbocharger comprising:

the radial turbine according to claim 5; and a compressor, wherein the compressor includes a compressor rotary shaft which is rotated about the axis, an impeller which is fixed to the compressor rotary shaft, and a compressor housing which covers the impeller, wherein the turbine rotary shaft and the compressor rotary shaft are positioned on the same axis to be connected to each other and are integrally rotated with each other to form a turbocharger rotary shaft.

* * * * *